US010031545B1

(12) United States Patent
Chae et al.

(10) Patent No.: US 10,031,545 B1
(45) Date of Patent: Jul. 24, 2018

(54) POWER CONVERSION SYSTEM CONSIDERING EFFICIENCY CHARACTERISTIC AND METHOD OF CONTROLLING SAME

(71) Applicant: KOREA INSTITUTE OF ENERGY RESEARCH, Daejeon (KR)

(72) Inventors: Su Yong Chae, Daejeon (KR); Jong Bok Baek, Daejeon (KR); Seung Weon Yu, Daejeon (KR); Gyu Duk Kim, Daejeon (KR); Suk In Park, Daejeon (KR)

(73) Assignee: KOREA INSTITUTE OF ENERGY RESEARCH (KR)

( * ) Notice: Subject to any disclaimer, the term of this patent is extended or adjusted under 35 U.S.C. 154(b) by 0 days.

(21) Appl. No.: 15/648,767

(22) Filed: Jul. 13, 2017

(30) Foreign Application Priority Data

Jun. 23, 2017 (KR) ..... 10-2017-0079418

(51) Int. Cl.
*G05F 5/00* (2006.01)

(52) U.S. Cl.
CPC ..... *G05F 5/00* (2013.01)

(58) Field of Classification Search
CPC . G05F 5/00; G05F 1/455; G05F 1/445; G05F 1/45; H02M 3/158; H02M 5/2576; H02M 2001/0012
See application file for complete search history.

(56) References Cited

U.S. PATENT DOCUMENTS

| | | | | |
|---|---|---|---|---|
| 9,112,411 | B2 | 8/2015 | Chae et al. | |
| 9,293,945 | B2 | 3/2016 | Song et al. | |
| 9,490,709 | B2 | 11/2016 | Lee et al. | |
| 9,637,017 | B2 | 5/2017 | Sung et al. | |
| 2009/0058379 | A1* | 3/2009 | Sreenivas | H02M 3/1584 323/241 |
| 2017/0025950 | A1* | 1/2017 | Wu | H02M 3/1584 |

* cited by examiner

*Primary Examiner* — Adolf Berhane
*Assistant Examiner* — Afework Demisse
(74) *Attorney, Agent, or Firm* — Harness, Dickey & Pierce, P.L.C.

(57) ABSTRACT

A power conversion system including: a first power conversion module configured to change a current (first module current) supplied to an output node, to monitor efficiency of the power conversion system according to the change in the first module current, and to determine a setting value of the first module current to increase the efficiency; and a second power conversion module configured to control a current (second module current) supplied to the output node according to a voltage (output voltage) formed at the output node.

15 Claims, 7 Drawing Sheets

POWER CONVERSION SYSTEM CONSIDERING EFFICIENCY CHARACTERISTIC AND METHOD OF CONTROLLING SAME

CROSS REFERENCE TO RELATED APPLICATION

This application claims priority from Korean Patent Application No. 10-2017-0079418, filed on Jun. 23, 2017, which is hereby incorporated by reference for all purposes as if fully set forth herein.

BACKGROUND OF THE INVENTION

1. Field of the Invention

The present invention relates to a technology for converting power.

2. Description of the Prior Art

A plurality of power conversion modules may be connected to each other in parallel to constitute one power conversion system.

The power conversion system generated through the parallel connection of the plurality of power conversion modules has an advantage in that even though one power conversion module breaks down, power can be supplied through the remaining power conversion modules. Further, the power conversion system generated through the parallel connection of the plurality of power conversion modules may easily increase or decrease throughput by adding or removing the power conversion module.

In the power conversion system generated through the parallel connection of the plurality of power conversion modules, it is important to properly distribute processing power amounts of the respective power conversion modules. In general, controlling the processing power amounts of the respective power conversion modules to be equal is known as the most desirable control method. In the power conversion system generated through the parallel connection of the plurality of power conversion modules, it is important to manage life spans of the respective power conversion modules to be similar. In general, it is known that the life spans of the respective power conversion modules are managed to be similar when the processing power amounts of the respective power conversion modules are controlled to be equal.

Although equally distributing the processing power amounts of the respective power conversion modules is somewhat reasonable in terms of their life spans, it is not the best method. The respective power conversion modules have different characteristics due to difference in manufacturing processes, difference in components, or difference in environments. When the same processing power amount is applied to power conversion modules having different characteristics, the power conversion module having a high efficiency characteristic sufficiently maintains its life span, but the power conversion module having a low efficiency characteristic relatively rapidly reduces its life span.

Accordingly, equally distributing the processing power amounts of the respective power conversion modules is not the best method in terms of efficiency of the whole power conversion system as well as in terms of their life spans. When the same processing power amount is applied to both the power conversion module having the high efficiency characteristic and the power conversion module having the low efficiency characteristic, the efficiency of the whole power conversion system becomes low.

SUMMARY OF THE INVENTION

Under such a background, an aspect of the present invention is to provide a technology for improving efficiency of a power conversion system in which a plurality of power conversion modules are connected to each other in parallel. Another aspect of the present invention is to provide a technology for equally managing life spans of respective power conversion modules in the power conversion system in which the plurality of power conversion modules are connected to each other in parallel.

In accordance with an aspect of the present invention, a power conversion system is provided. The power conversion system includes: a first power conversion module configured to change a current (first module current) supplied to an output node, to monitor efficiency of the power conversion system according to the change in the first module current, and to determine a setting value of the first module current to increase the efficiency; and a second power conversion module configured to control a current (second module current) supplied to the output node according to a voltage (output voltage) formed at the output node.

In the power conversion system, the first power conversion module may determine the setting value of the first module current according to an output value of a first droop logic having the output voltage as an input, and the second power conversion module may determine a setting value of the second module current according to an output value of a second droop logic having the output voltage as an input.

The first droop logic may include a droop function having the output voltage as a factor, and the first power conversion module may change the first module current by changing a coefficient of the droop function.

When the setting value of the first module current is determined, the first power conversion module may set the droop function as a coefficient of the droop function corresponding to the determined setting value of the first module current. The droop function may include a linear function, and the first power conversion module may change the first module current by changing a slope or an intercept of the linear function.

The first droop logic may include different droop functions in respective intervals of the output voltage, and at this time, the first power conversion module may determine an interval according to the output voltage and change the first module current by changing a coefficient of the droop function corresponding to the determined interval.

The first power conversion module may set, as the setting value of the first module current, a value at a position where the efficiency decreases when the first module current increases and the efficiency decreases when the first module current decreases.

The first power conversion module may change the first module current within a predetermined range, and when the efficiency becomes maximum at a maximum value or a minimum value of the predetermined range, determine the maximum value or the minimum value as the setting value of the first module current.

When the output voltage escapes from a predetermined interval, the first power conversion module may re-determine the setting value of the first module current by re-changing the first module current.

When the first module current escapes from a predetermined interval, the first power conversion module may re-determine the setting value of the first module current by re-changing the first module current.

After the first module current is determined, the second power conversion module may change the second module current, monitor the efficiency of the power conversion system according to the change in the second module current, and determine a setting value of the second module current to increase the efficiency.

In accordance with another aspect of the present invention, a method of controlling a power conversion system including N (N is a natural number larger than or equal to 2) power conversion modules connected to each other in parallel is provided. The method includes: controlling each power conversion module according to a preset droop logic; making a control to change a current (module current) that each power conversion module supplies to an output node while sequentially controlling the N power conversion modules, monitoring efficiency of the power conversion system according to the change in the module current, and determining a setting value of the module current of each power conversion module to increase the efficiency.

In accordance with another aspect of the present invention, a power conversion system is provided. The power conversion system includes: a device configured to measure an input voltage and an input current supplied to an input node, to measure an output voltage and an output current output from an output node, and to calculate efficiency of the power conversion system based on the input voltage, the input current, the output voltage, and the output current; a first power conversion module configured to change a setting value of an embedded first droop logic according to a control signal received from the device, and to determine the setting value of the first droop logic to increase a value of the efficiency received from the device; and a second power conversion module including a second droop logic therein and configured to control a current supplied to the output node according to the second droop logic.

The power conversion system may include N (N is a natural number larger than or equal to 2) power conversion modules including the first power conversion module and the second power conversion module. The device may make a control to change a setting value of the droop logic included in each power conversion module by sequentially transmitting the control signal to the N power conversion modules.

When the output current is changed by a predetermined condition or more, the device may transmit the control signal to the first power conversion module, and when the input current is changed by a predetermined condition or more, the device may transmit the control signal to the first power conversion module.

As described above, the present invention has an effect of increasing efficiency of the power conversion system in which the plurality of power conversion modules are connected to each other in parallel and equally managing life spans of the respective power conversion modules.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
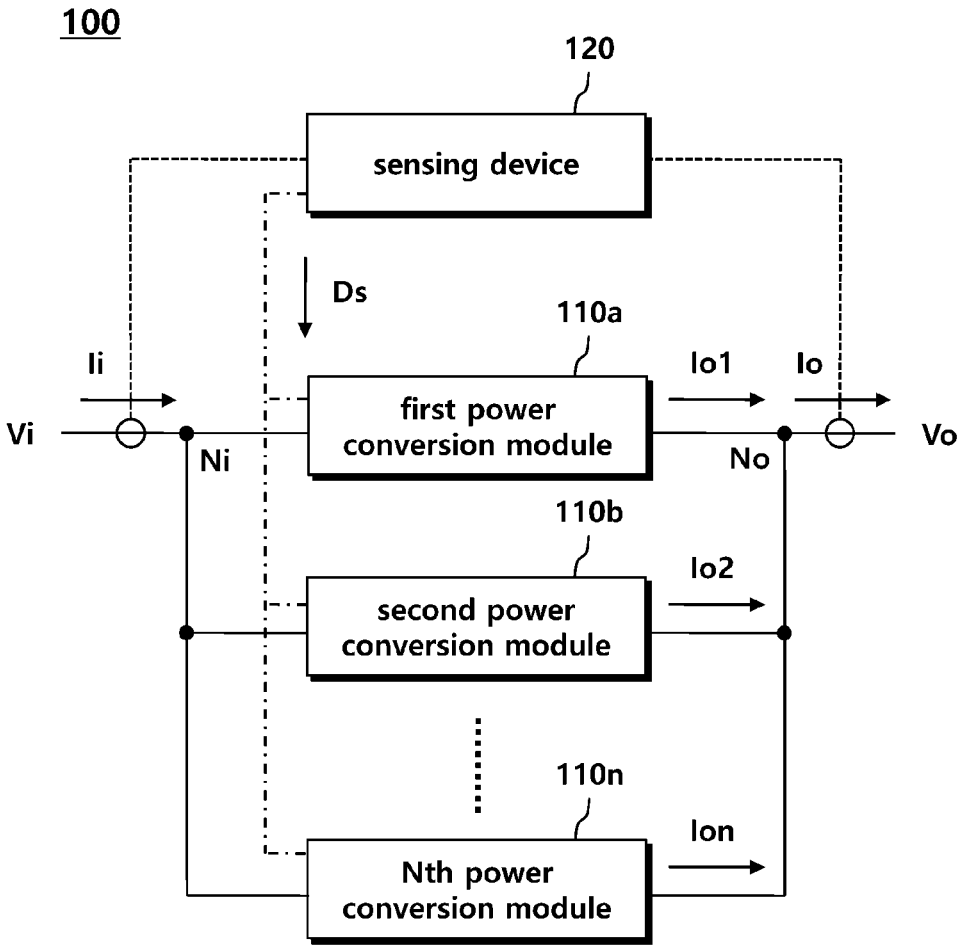
FIG. 1 is a block diagram illustrating a power conversion system according to an embodiment.

Hereinafter, embodiments of the present invention will be described in detail with reference to the accompanying drawings. In adding reference numerals to elements in each drawing, the same elements will be designated by the same reference numerals, if possible, although they are shown in different drawings. Further, in the following description of the present invention, a detailed description of known functions and configurations incorporated herein will be omitted when it is determined that the description may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 is a block diagram illustrating a power conversion system according to an embodiment.

Referring to FIG. 1, a power conversion system (100) may include a plurality of power conversion modules (110*a*, 110*b*, . . . , and 110*n*).

The plurality of power conversion modules (110*a*, 110*b*, . . . , and 110*n*) may convert an input voltage (Vi) to generate an output voltage (Vo). Each power conversion module (110*a*, 110*b*, . . . , or 110*n*) may include a generally known type converter circuit therein. For example, each power conversion module (110*a*, 110*b*, . . . , or 110*n*) may include a buck type converter circuit therein, or include generally known various types of converter circuits such as a boost type converter circuit, a buck-boost type converter circuit, and the like.

The plurality of power conversion modules (110*a*, 110*b*, . . . , and 110*n*) may be connected to each other in parallel while sharing an input node (Ni) and an output node (No). Module currents (Io1, Io2, . . . , and Ion) output from the plurality of power conversion modules (110*a*, 110*b*, . . . , and 110*n*) may be combined at the output node (No) to form an output current (Io).

Efficiency of the power conversion system (100) may be calculated as the following equation.

$$\text{Efficiency}=\text{output power}/\text{input power}=(\text{output voltage } (Vo)\times\text{output current } (Io))/(\text{input voltage } (Vi)\times\text{input current } (Ii)) \quad \text{Equation (1)}$$

The power conversion system (100) may control the module currents (Io1, Io2, and Ion) of the respective power conversion modules (110*a*, 110*b*, . . . , and 110*n*) to increase the efficiency. For example, if the efficiency increases when the module current (Io1) of the first power conversion module (110*a*) increases, the power conversion system (100) may increase the module current (Io1) of the first power conversion module (110*a*).

Each power conversion module (110*a*, 110*b*, . . . , or 110*n*) may set a setting value of the module current (Io1, Io2, . . . , or Ion) to increase the efficiency of the power conversion system (100). For example, the first power conversion module (110*a*) may determine the setting value of the module current (Io1) such that the efficiency of the power conversion system (100) increases.

Each power conversion module (110*a*, 110*b*, . . . , or 110*n*) may change the module current (Io1, Io2, . . . , or Ion) supplied to the output node (No), monitor the efficiency of the power conversion system (100) according to the change in the module current (Io1, Io2, . . . , or Ion), and determine the setting value of the module current (Io1, Io2, . . . , or Ion) to increase the efficiency.

For example, the first power conversion module (110*a*) may increase the first module current (Io1) supplied to the output node (No). Further, the first power conversion module (110*a*) may monitor the efficiency of the power conversion system (100) according to the increase in the first module current (Io1). When the efficiency increases according to the increase in the first module current (Io1), the first power conversion module (110*a*) may determine a value of the increased first module current (Io1) as the setting value. Inversely, when the efficiency of the power conversion system (100) decreases according to the increase in the first module current (Io1), the first power conversion module (110*a*) may decrease the first module current (Io1) after determining the setting value of the first module current (Io1) as the value before the increase. When the efficiency increases according to the decrease in the first module current (Io1), the first power conversion module (110*a*) may set the setting value of the first module current (Io1) as the decreased value. When the efficiency decreases according to the decrease in the first module current (Io1), the first power conversion module (110*a*) may set the setting value of the first module current (Io1) as the value before the decrease.

Each power conversion module (110*a*, 110*b*, . . . , or 110*n*) may determine each module current (Io1, Io2, . . . , or Ion) such that the efficiency becomes a localized maximum point. For example, each power conversion module (110*a*, 110*b*, . . . , or 110*n*) may determine that a value at a position where the efficiency decreases when the module current (Io1, Io2, . . . , or Ion) increases and the efficiency decreases when the module current (Io1, Io2, . . . , or Ion) decreases becomes the setting value of the module current (Io1, Io2, . . . , or Ion). In general, the position corresponds to an upwardly convex position on a curve.

Each power conversion module (110*a*, 110*b*, . . . , or 110*n*) may change the module current (Io1, Io2, . . . , or Ion) within a predetermined range in order to prevent the deviation of the module currents from significantly being large. At this time, when there is no localized maximum point within the predetermined range, that is, when there is no upwardly convex position, each power conversion module (110*a*, 110*b*, . . . , or 110*n*) may find a position where the efficiency becomes maximum at a maximum value or a minimum value of the predetermined range. When the efficiency becomes maximum at the maximum value or the minimum value of the predetermined range, each power conversion modules (110*a*, 110*b*, . . . , or 110*n*) may determine the maximum value or the minimum value as the setting value of each module current (Io1, Io2, . . . , or Ion).

The power conversion modules (110*a*, 110*b*, . . . , and 110*n*) may sequentially change the module currents (Io1, Io2, . . . , and Ion) one by one. For example, the first power conversion module (110*a*) may determine the setting value of the first module current (Io1) to increase the efficiency while changing the first module current (Io1). Thereafter, the second power conversion module (110*b*) may determine the setting value of the second module current (Io2) to increase the efficiency while changing the second module current (Io2). Through the sequential process, the $N^{th}$ (N is a natural number larger than or equal to 2) power conversion module (110*n*) may determine the setting value of the $N^{th}$ module current (Ion) to increase the efficiency while changing the $N^{th}$ module current (Ion).

Here, the module current (Io1, Io2, . . . , or Ion) of each power conversion module (110*a*, 110*b*, . . . , or 110*n*) is not always fixed to one value. When the output current (Io) is constant, each power conversion module (110*a*, 110*b*, . . . , or 110*n*) temporarily sets its own module current by finding a position where the efficiency becomes maximum while changing its own module current. The module current (Io1, Io2, . . . , or Ion) of each power conversion module (110*a*, 110*b*, . . . , or 110*n*) may be changed in accordance with the change in the module current of another power conversion module. For example, in a situation where a load current or the output current (Io) is constant, when the first module current (Io1) increases, the second module current (Io2) may decrease. Each power conversion module (110*a*, 110*b*, . . . , or 110*n*) may form a mutual relation therebetween through a drop control, which will be described below.

The input current (Ii), the input voltage (Vi), the output current (Io), and the output voltage (Vo) of the power conversion system (100) may be measured by a sensing device (120). The sensing device (120) may calculate the efficiency of the power conversion system (100) based on the measured values and transmit information on the efficiency to each power conversion module (110*a*, 110*b*, . . . , or 110*n*). Alternatively, the sensing device (120) may transmit information (Ds) on the measured values to each power conversion module (110*a*, 110*b*, . . . , or 110*n*), and each power conversion module (110*a*, 110*b*, . . . , or 110*n*) may calculate the efficiency of the power conversion system (100) based on the information (Ds) on the measured values.

Meanwhile, as described above, each power conversion module (110*a*, 110*b*, . . . , or 110*n*) may find the position where the efficiency of the power conversion system (100) becomes maximum by changing the module current (Io1, Io2, . . . , or Ion), and an example of the process will be described with respect to FIG. 2.

Figure 2:
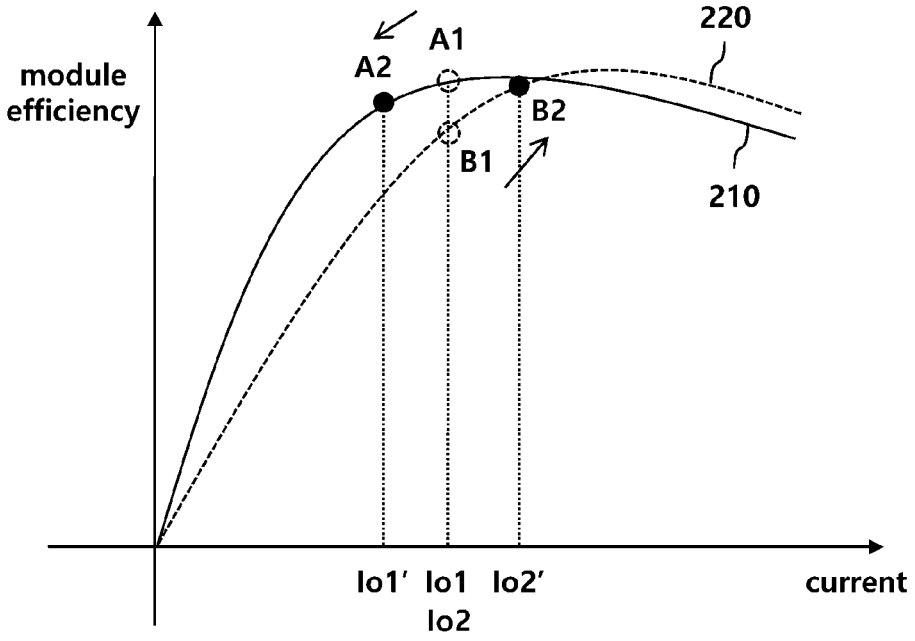
FIG. 2 illustrates an example of a module efficiency curve to describe a process of improving the efficiency of the power conversion system by changing the module current.

FIG. 2 illustrates an example of a module efficiency curve to describe a process of improving the efficiency of the power conversion system by changing the module current.

Referring to FIG. 2, since characteristics of the respective power conversion modules are different, an efficiency curve (210) of the first power conversion module and an efficiency curve (220) of the second power conversion module may be different.

In spite of the difference in the efficiency characteristic between power conversion modules, the module current (Io1) of the first power conversion module and the module current (Io2) of the second power conversion module were equally controlled in the prior art as shown at position A1 and position B1.

However, the power conversion system according to an embodiment may set each module current to increase the efficiency of the power conversion system while changing the module current of each power conversion module.

According to the above control, a module current (Io1') of the first power conversion module moves to position A2 from position A1 and a module current (Io2') of the second power conversion module moves to position B2 from position B1. Since there is little difference in module efficiency between position A1 and position A2, the first power conversion module has small loss of the module efficiency in spite of the movement of the control point from A1 to A2. On the contrary, when the control point moves from B1 to B2, the module efficiency of the second power conversion module significantly increases since there is a large difference in the module efficiency between position B1 and position B2. As a result, rather than controlling the first power conversion module and the second power conversion module to move to position A1 and position B1, controlling the first power conversion module and the second power conversion module to move to position A2 and position B2 improves the efficiency of the total power conversion system.

As described above, the power conversion system according to an embodiment may increase the efficiency of the power conversion system while changing the module current of each power conversion module.

Figure 3:
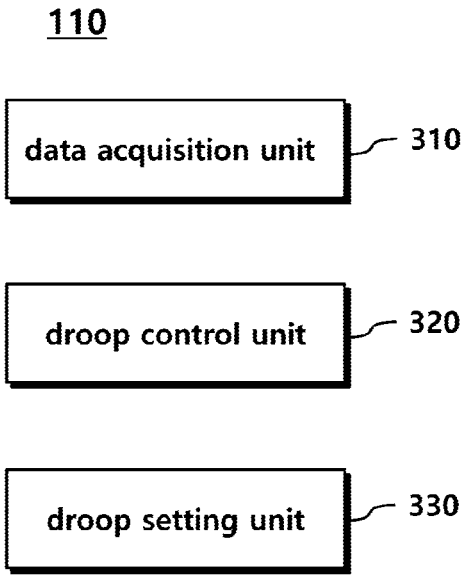
FIG. 3 is a block diagram illustrating the power conversion module according to an embodiment.

FIG. 3 is a block diagram illustrating the power conversion module according to an embodiment.

Referring to FIG. 3, the power conversion module (110) may include a data acquisition unit (310), a droop control unit (320), and a droop setting unit (330).

The data acquisition unit (310) corresponds to a part for acquiring an input current, an input voltage, an output current, an output voltage, efficiency, and the like.

The data acquisition unit (310) may acquire a value of the efficiency of the power conversion system from an external device, for example, a sensing device. Alternatively, the data acquisition unit (310) may acquire an input current, an input voltage, an output current, and an output voltage from an external device and calculate the efficiency based on the acquired input current, input voltage, output current, and output voltage.

The data acquisition unit (310) may measure the input current, input voltage, output current, and output voltage through a sensor.

The data acquisition unit (310) may acquire information on some of the input current, the input voltage, the output current, the output voltage, and the efficiency from the external device, and measure information on the others through the sensor. For example, the data acquisition unit (310) may acquire the efficiency of the power conversion system from the external device, and measure the output voltage through the sensor.

The droop control unit (320) may control the current (module current) supplied to the output node according to the voltage (output voltage) formed at the output node, and for example, control the output voltage and the module current of the power conversion module (110) by using the droop logic.

The droop logic may have the output voltage as an input and the setting value of the module current as an output value. For example, the first power conversion module may include a first droop logic and determine the setting value of the first module current according to an output value of the first droop logic having the output voltage as the input, and the second power conversion module may include a second droop logic and determine the setting value of the second module current according to an output value of the second droop logic having the output voltage as the input.

The droop logic may include a droop function having the output voltage as a factor. The droop function may be, for example, a polynomial expression having the output voltage as a variable (factor).

The droop setting unit (330) may change the module current output by the power conversion module (110) by changing the setting of the droop logic.

For example, when the droop logic includes a droop function consisting of a polynomial expression having the output voltage as a variable (factor), the droop setting unit (330) may change the module current by changing a coefficient of the droop function. When the droop function corresponds to a linear function, the droop setting unit (330) may change the module current by changing a slope or an intercept of the linear function.

Figure 4:
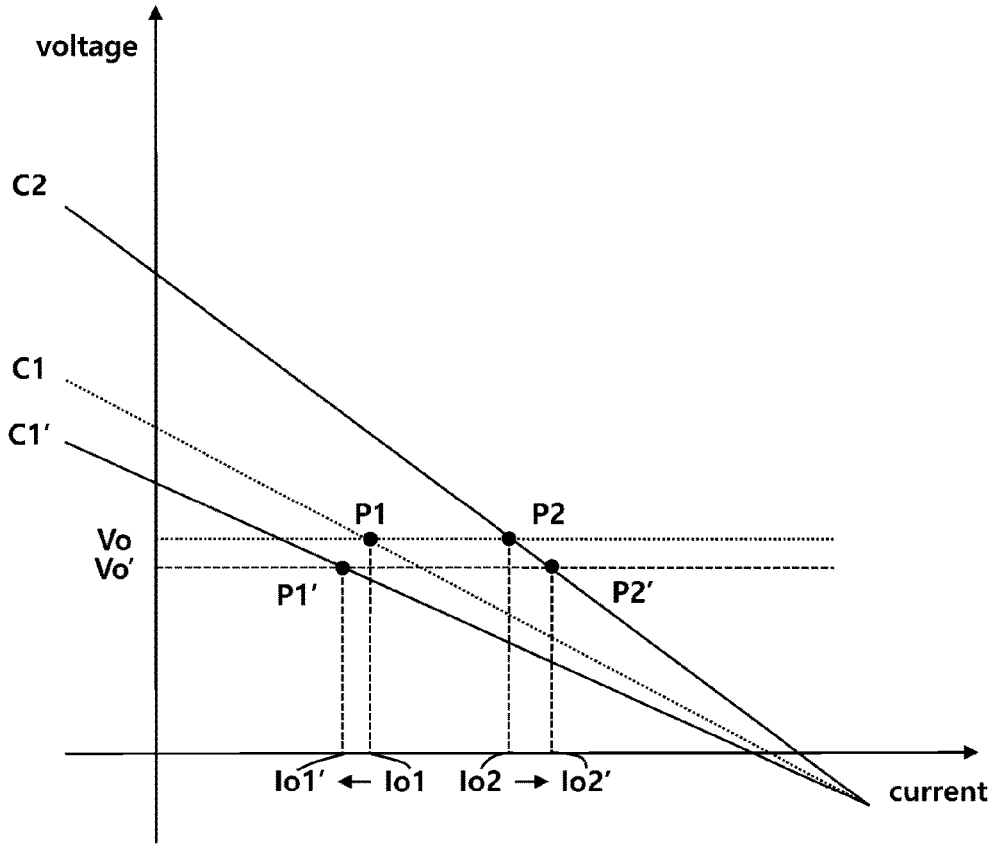
FIG. 4 illustrates an example where the power conversion module changes the module current by changing the droop function according to an embodiment.

FIG. 4 illustrates an example where the power conversion module changes the module current by changing the droop function according to an embodiment.

Referring to FIG. 4, the first power conversion module may include a first droop function according to a first drop curve (C1), and the second power conversion module may include a second droop function according to a second droop curve (C2). At this time, the size of the module current output by each power conversion module is determined according to the output voltage (Vo). For example, the first power conversion module may determine the first module current (Io1) according to a first position (P1) where the first droop curve (C1) and the output voltage (Vo) meet each other, and the second power conversion module may determine the second module current (Io2) according to a second position (P2) where the second droop curve (C2) and the output voltage (Vo) meet each other.

Meanwhile, the power conversion module may change the module current by changing the setting of the droop logic. For example, the power conversion module may change the module current by changing a coefficient of the droop function included in the droop logic.

Referring to FIG. 4, the first power conversion module may change the droop curve from the first droop curve (C1) to a first droop curve' (C1'). According to the change in the droop curve, the module current output by the first power conversion module may be changed from the first module current (Io1) to a first module current' (Io1'). Since the output voltage (Vo) is also changed according to the change in the module current, the module current (Io1') of the first power conversion module may be determined at a first position' (P1') where the first droop curve' (C1') and the changed output voltage (Vo') meet each other.

According to characteristics of the droop control, when the module current of the first power conversion module is changed, the module current of the second power conversion module is changed from the second module current (Io2) to a second module current' (Io2'). More specifically, as the module current of the first power conversion module is changed, the output voltage is changed and the second module current' (Io2') is formed at a position (P2') where the changed output voltage (Vo') and the second droop curve (C2) meet each other.

Although the example in which the droop logic consists of the linear function has been described with reference to FIG. 4, the droop function may consist of a quadratic or greater function or a non-linear function including different droop functions in respective intervals.

Figure 5:
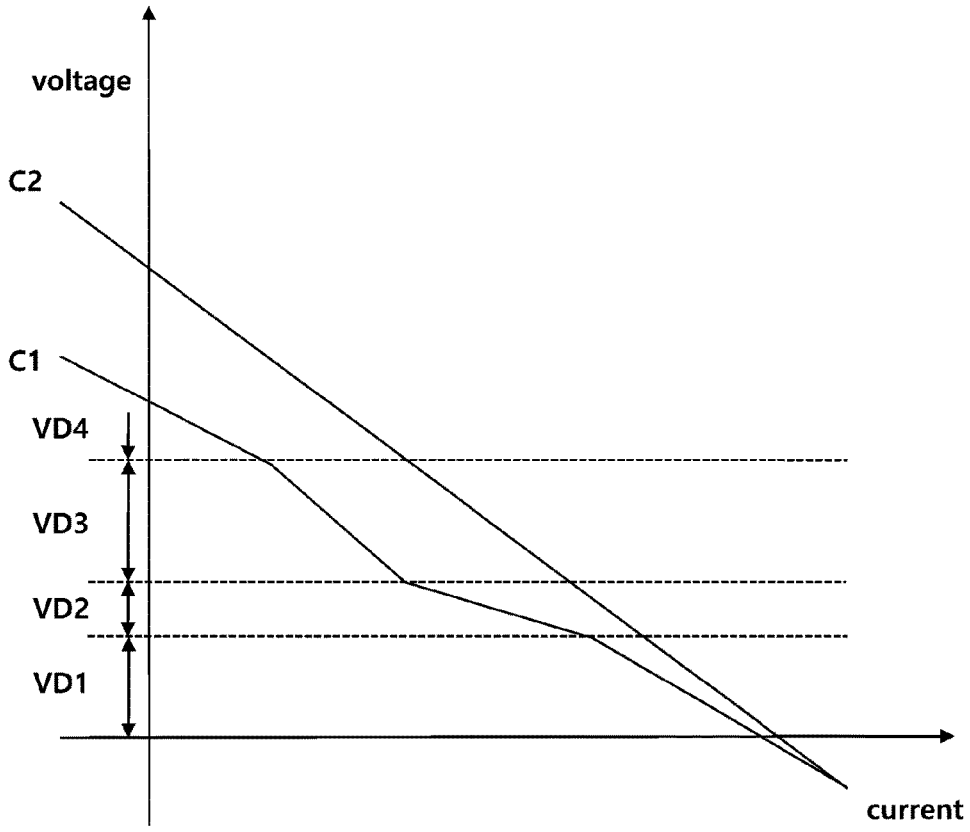
FIG. 5 illustrates an example where the power conversion module includes different droop functions in respective intervals according to an embodiment.

FIG. 5 illustrates an example where the power conversion module includes different droop functions in respective intervals according to an embodiment.

Referring to FIG. 5, the second droop curve (C2) may consist of a linear function, and the first droop curve (C1) may consist of different droop functions in respective intervals (VD1, VD2, VD3, and VD4).

The droop functions included in the droop logic may be determined in a process of optimizing the efficiency in each power conversion module. When each power conversion module performs the optimization process with the divided intervals (VD1, VD2, VD3, and VD4) of the output voltage, the droop logic may include different droop functions in the respective intervals (VD1, VD2, VD3, and VD4) as illustrated in FIG. 5.

In a detailed example, the first power conversion module may determine an interval according to the output voltage and change the first module current by changing a coefficient of the droop function corresponding to the determined interval. Further, the first power conversion module may set a droop function coefficient of the corresponding interval such that the power conversion system has maximum efficiency. The power conversion module may change the module current by changing the setting of the droop logic, for example, the coefficient of the droop function and determine the setting value of the module current to increase the efficient of the power conversion system. At this time, when the setting value of the module current is determined, the power conversion module may store the setting of the droop logic corresponding to the determined setting value of the module current, for example, the coefficient of the droop function.

Meanwhile, the power conversion module may determine the setting value of the module current to increase the efficiency by periodically changing the module current. Further, when a particular condition is met, the power conversion module may determine the setting value of the module current to increase the efficiency by changing the module current.

For example, when the output voltage escapes from a predetermined interval, the power conversion module may re-determine the setting value of the module current by re-changing the module current. When the droop logic includes different droop functions in respective intervals of the output voltage and the output voltage moves between the intervals and thus changes, the power conversion module may re-determine the setting value of the module current by re-changing the module current.

In another example, when the module current escapes from a predetermined interval, the power conversion module may re-determine the setting value of the module current by re-changing the module current. When the module current is divided according to the interval and moves between the intervals, the power conversion module may re-determine the setting value of the module current by re-changing the module current. Alternatively, when the module current changes by a preset size or more, the power conversion module may re-determine the setting value of the module current by re-changing the module current.

Figure 6:
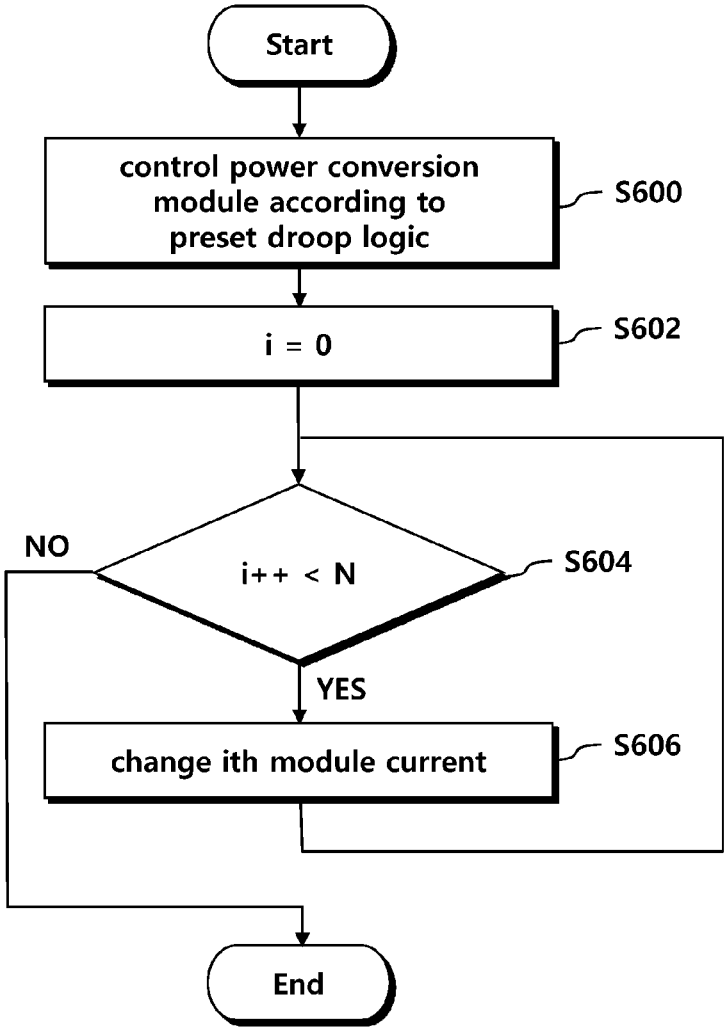
FIG. 6 is a flowchart illustrating a method of controlling the power conversion system according to an embodiment.

FIG. 6 is a flowchart illustrating a method of controlling the power conversion system according to an embodiment.

Referring to FIG. 6, the power conversion system including (N) power conversion modules connected to each other in parallel may control each power conversion module according to a preset droop logic in (S600). The droop logic may include a droop function, and the droop function may include a coefficient that can be set. Each power conversion module may have a droop function including a preset coefficient therein. Further, the power conversion module may perform a droop control by using the droop function.

The power conversion system may initialize a count i in S602, and increase the count until the count i becomes N in S604.

Further, the power conversion system may make a control to change the current (module current) that each power conversion module supplies to the output node while sequentially controlling (N) power conversion modules, monitor the efficiency of the power conversion system according to the change in the module current, and determine the setting value of the module current of each power conversion module to increase the efficiency in S606.

In a detailed example, when the count i is smaller than N (Yes in S604), the power conversion system may determine the setting value of the module current of the $i^{th}$ power conversion module to increase the efficiency of the power conversion system by changing the module current of the $i^{th}$ power conversion module in S606. Here, the determination of the setting value of the module current of the power conversion module may be the same as the determination of the setting value of the droop logic included in the power conversion module. When the setting value of the droop logic is determined, the setting value of the module current may be determined according to the output voltage.

Figure 7:
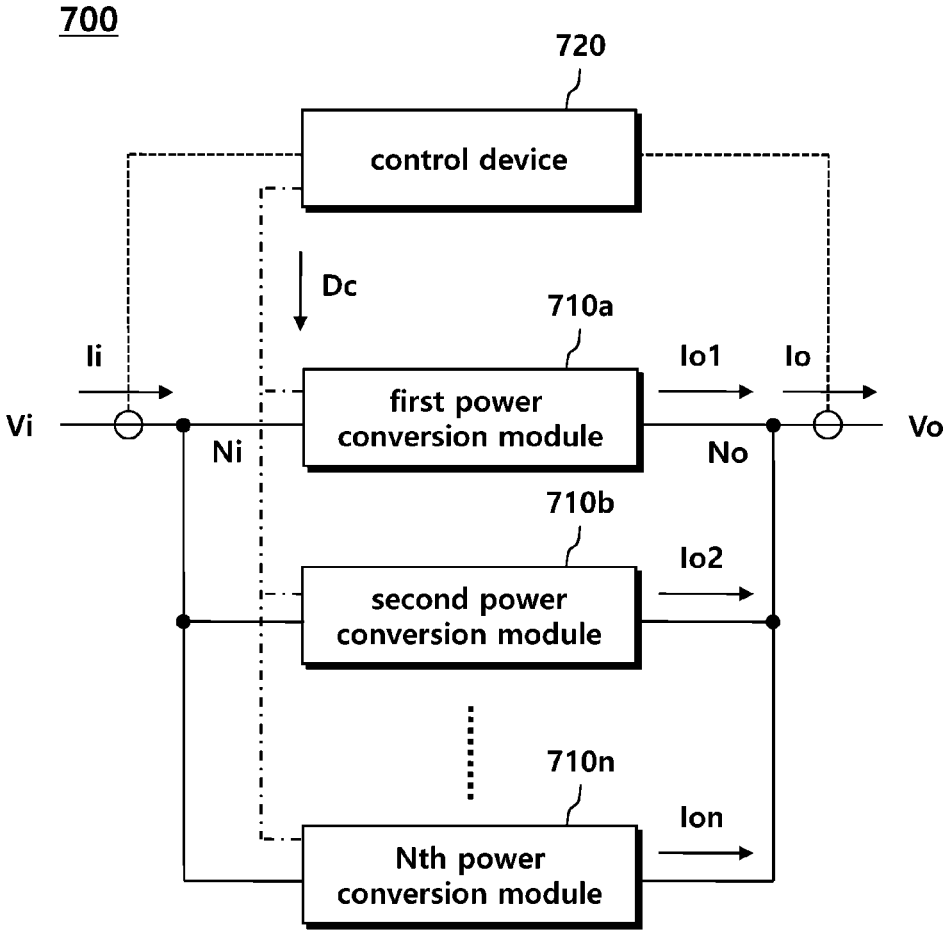
FIG. 7 is a block diagram illustrating the power conversion system according to another embodiment.

FIG. 7 is a block diagram illustrating the power conversion system according to another embodiment.

Referring to FIG. 7, a power conversion system (700) may include a plurality of power conversion modules (710*a*, 710*b*, . . . , and 710*n*), and a control device (720).

The control device (720) may measure an input voltage (Vi) and an input current (Ii) supplied to an input node (Ni), measure an output voltage (Vo) and an output current (Io) output from an output node (No), and calculate efficiency of the power conversion system (700) based on the input voltage (Vi), the input current (Ii), the output voltage (Vo), and the output current (Io).

Further, the control device (720) may transmit a control signal (Dc) to the plurality of power conversion modules (710*a*, 710*b*, . . . , and 710*n*). The control signal (Dc) may be, for example, a start control signal to allow each power conversion module (710*a*, 710*b*, . . . , or 710*n*) to change a setting value of the drop logic or a stop control signal to allow each power conversion module (710*a*, 710*b*, . . . , or 710*n*) to stop changing the setting value of the droop logic.

The control signal (Dc) may include information related to the efficiency. For example, the control signal (Dc) may include an efficiency value of the power conversion system (700). Alternatively, the control signal (Dc) may include at least one value of the input voltage (Vi), the input current (Ii), the output voltage (Vo), and the output current (Io). Each power conversion module (710*a*, 710*b*, . . . , or 710*n*) may identify the efficiency of the power conversion system (700) by checking the information included in the control signal (Dc).

Each power conversion module (710*a*, 710*b*, . . . , or 710*n*) includes the droop logic therein and may control the current (Io1, Io2, . . . , or Ion) supplied to the output node according to the droop logic.

Further, each power conversion module (710*a*, 710*b*, . . . , or 710*n*) may change the setting value of the embedded droop logic according to the control signal (Dc) received from the control device (720), and determine the setting value of the droop logic such that the value of the efficiency received from the control device (720) increases.

The control device (720) may change the setting value of the droop logic included in each power conversion module (710*a*, 710*b*, . . . , or 710*n*) by sequentially transmitting the control signal (Dc) to the N power conversion modules (710*a*, 710*b*, . . . , and 710*n*).

The control device (720) may determine the setting value again by re-changing the setting value after determining the setting value of the droop logic of each power conversion module (710*a*, 710*b*, . . . , or 710*n*).

For example, the control device (720) may optimize the setting value of the droop logic included in each power conversion module (710*a*, 710*b*, . . . , or 710*n*) by periodically transmitting the control signal (Dc) to each power conversion module (710*a*, 710*b*, . . . , or 710*n*).

In another example, when the output current (Io) is changed by a predetermined condition or more, the control device (720) may optimize each power conversion module (710*a*, 710*b*, . . . , or 710*n*) by transmitting the control signal (Dc) to each power conversion module (710*a*, 710*b*, . . . , or 710*n*).

In still another example, when the input current (Ii) is changed by a predetermined condition or more, the control device (720) may optimize each power conversion module (710*a*, 710*b*, . . . , or 710*n*) by transmitting the control signal (Dc) to each power conversion module (710*a*, 710*b*, . . . , or 710*n*).

As described above, the embodiments of the present invention have an effect of increasing the efficiency of the power conversion system in which the plurality of power conversion modules are connected to each other in parallel and equally managing life spans of the respective power conversion modules.

In addition, since terms, such as "including," "comprising," and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present invention expressly defines them so.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A power conversion system, the system comprising:

a first power conversion module configured to change a first module current supplied to an output node, to monitor efficiency of the power conversion system according to the change in the first module current, and to determine a setting value of the first module current to increase the efficiency; and a second power conversion module configured to control a second module current supplied to the output node according to a voltage (output voltage) formed at the output node, wherein the first power conversion module determines, as the setting value of the first module current, a value at a position where the efficiency decreases when the first module current increases and the efficiency decreases when the first module current decreases.

2. The power conversion system of claim 1, wherein the first power conversion module determines the setting value of the first module current according to an output value of a first droop logic having the output voltage as an input, and the second power conversion module determines a setting value of the second module current according to an output value of a second droop logic having the output voltage as an input.

3. The power conversion system of claim 2, wherein the first droop logic includes a droop function having the output voltage as a factor, and the first power conversion module changes the first module current by changing a coefficient of the droop function.

4. The power conversion system of claim 3, wherein, when the setting value of the first module current is determined, the first power conversion module sets the droop function as a coefficient of the droop function corresponding to the determined setting value of the first module current.

5. The power conversion system of claim 3, wherein the droop function includes a linear function, and the first power conversion module changes the first module current by changing a slope or an intercept of the linear function.

6. The power conversion system of claim 3, wherein the first droop logic includes different droop functions in respective intervals of the output voltage, and the first power conversion module determines an interval according to the output voltage and changes the first module current by changing a coefficient of the droop function corresponding to the determined interval.

7. The power conversion system of claim 1, wherein the first power conversion module changes the first module current within a predetermined range, and when the efficiency becomes maximum at a maximum value or a minimum value of the predetermined range, determines the maximum value or the minimum value as the setting value of the first module current.

8. The power conversion system of claim 1, wherein, after the first module current is determined, the second power conversion module changes the second module current, monitors the efficiency of the power conversion system according to the change in the second module current, and determines a setting value of the second module current to increase the efficiency.

9. A power conversion system, the system comprising:

a first power conversion module configured to change a first module current supplied to an output node, to monitor efficiency of the power conversion system according to the change in the first module current, and to determine a setting value of the first module current to increase the efficiency; and a second power conversion module configured to control a second module current supplied to the output node according to a voltage (output voltage) formed at the output node, wherein, when the output voltage escapes from a predetermined interval, the first power conversion module re-determines the setting value of the first module current by re-changing the first module current.

10. A power conversion system, the system comprising:

a first power conversion module configured to change a first module current supplied to an output node, to monitor efficiency of the power conversion system according to the change in the first module current, and to determine a setting value of the first module current to increase the efficiency; and a second power conversion module configured to control a second module current supplied to the output node according to a voltage (output voltage) formed at the output node, wherein, when the first module current escapes from a predetermined interval, the first power conversion module re-determines the setting value of the first module current by re-changing the first module current.

11. A power conversion system comprising:

a device configured to measure an input voltage and an input current supplied to an input node, to measure an output voltage and an output current output from an output node, and to calculate efficiency of the power conversion system based on the input voltage, the input current, the output voltage, and the output current;

a first power conversion module configured to change a setting value of an embedded first droop logic according to a control signal received from the device, and to determine the setting value of the first droop logic to increase a value of the efficiency received from the device; and a second power conversion module including a second droop logic therein and configured to control a current supplied to the output node according to the second droop logic.

12. The power conversion system of claim 11, wherein the power conversion system comprises N (N is a natural number larger than or equal to 2) power conversion modules including the first power conversion module and the second power conversion module, and the device makes a control to change a setting value of the droop logic included in each power conversion module by sequentially transmitting the control signal to the N power conversion modules.

13. The power conversion system of claim 11, wherein, when the output current is changed by a predetermined condition or more, the device transmits the control signal to the first power conversion module.

14. The power conversion system of claim 11, wherein, when the input current is changed by a predetermined condition or more, the device transmits the control signal to the first power conversion module.

15. The power conversion system of claim 11, wherein the control signal is a start control signal to start changing a setting value of the droop logic or a stop control signal to stop changing the setting value of the droop logic.

* * * * *